US012616317B2

(12) United States Patent
Hu

(10) Patent No.: US 12,616,317 B2
(45) Date of Patent: May 5, 2026

(54) AUTOMATIC WEBBING WINDING DEVICE AND BEDSIDE BED HAVING THE SAME

(71) Applicant: WONDERLAND SWITZERLAND AG, Steinhausen (CH)

(72) Inventor: Junjie Hu, Steinhausen (CH)

(73) Assignee: WONDERLAND SWITZERLAND AG, Steinhausen (CH)

( * ) Notice: Subject to any disclaimer, the term of this patent is extended or adjusted under 35 U.S.C. 154(b) by 212 days.

(21) Appl. No.: 18/564,330

(22) PCT Filed: May 27, 2022

(86) PCT No.: PCT/EP2022/064436
§ 371 (c)(1),
(2) Date: Nov. 27, 2023

(87) PCT Pub. No.: WO2022/248679
PCT Pub. Date: Dec. 1, 2022

(65) Prior Publication Data

US 2024/0245228 A1 Jul. 25, 2024

(30) Foreign Application Priority Data

May 26, 2021 (CN) ..... 202110580700.2

(51) Int. Cl.
*A47D 9/00* (2006.01)
*B65H 75/44* (2006.01)

(52) U.S. Cl.
CPC ..... *A47D 9/016* (2022.08); *B65H 75/4431* (2013.01)

(58) Field of Classification Search
USPC ..... 242/378.2
See application file for complete search history.

(56) References Cited

U.S. PATENT DOCUMENTS 6,113,325 A * 9/2000 Craft ..... A61G 3/0808 410/23
6,616,080 B1 * 9/2003 Edwards ..... A45F 5/004 242/378.1

(Continued)

FOREIGN PATENT DOCUMENTS

CN 2391859 Y 8/2000
CN 102476767 A 5/2012

(Continued)

OTHER PUBLICATIONS

Written Opinion dated from corresponding application No. PCT/EP2022/064436 (7 pages).

(Continued)

*Primary Examiner* — William A. Rivera
(74) *Attorney, Agent, or Firm* — HAUPTMAN HAM, LLP

(57) ABSTRACT

An automatic webbing winding device includes: a base; a winding reel mounted on the base and rotatable around a center of the base; a coil spring mounted on the winding reel, one end of the coil spring is fixed to the winding reel, and the other end of the coil spring is fixed to the base; and a webbing mounted on the winding reel, the webbing includes a fixed end and a free end, the fixed end is fixed to the winding reel, and the free end extends out from the base; when the free end is pulled outward by an external force, the winding reel rotates along a forward direction, and the coil spring is elastically deformed, when the external force is removed, the winding reel rotates along a reverse direction under an elastic restoring force of the coil spring, thereby winding the webbing on the winding reel.

20 Claims, 15 Drawing Sheets

(56) References Cited

U.S. PATENT DOCUMENTS

| | | | | |
|---|---|---|---|---|
| 8,833,690 | B2 * | 9/2014 | Zhou | B65H 75/486 242/378 |
| 10,722,047 | B2 * | 7/2020 | Gallina | A47D 9/02 |
| 11,033,003 | B1 * | 6/2021 | Burkhardt | B65H 75/486 |
| 11,242,218 | B1 * | 2/2022 | Herman | B65H 75/48 |
| 12,285,117 | B2 * | 4/2025 | Tyneski | A47D 9/012 |
| 2005/0034232 | A1 * | 2/2005 | Martin | A47D 7/02 5/93.1 |
| 2009/0277454 | A1 * | 11/2009 | Davis | A61M 16/0875 128/207.18 |
| 2018/0206652 | A1 | 7/2018 | Gallina | |
| 2021/0120783 | A1 * | 4/2021 | Bowden | B65H 75/406 |
| 2023/0013107 | A1 * | 1/2023 | Momin | B65H 75/446 |

FOREIGN PATENT DOCUMENTS

| | | | |
|---|---|---|---|
| CN | 203558603 | | 4/2014 |
| CN | 108338591 | A | 7/2018 |
| CN | 211410098 | U | 9/2020 |
| DE | 3219570 | | 12/1983 |
| DE | 3219570 | A1 | 12/1983 |
| EP | 2719583 | | 4/2014 |
| EP | 2719583 | A1 | 4/2014 |
| EP | 3354165 | | 8/2018 |
| TW | 201826977 | | 8/2018 |

OTHER PUBLICATIONS

International Search Report dated Sep. 13, 2022 from corresponding application No. PCT/EP2022/064436 (4 pages).

TW Office Action from corresponding application No. TW 1111197383 (13 pages).

First Office Action in Corresponding Chinese Application No. 202110580700.2, dated Apr. 11, 2025; 12 pgs.

* cited by examiner

AUTOMATIC WEBBING WINDING DEVICE AND BEDSIDE BED HAVING THE SAME

CROSS REFERENCE TO RELATED APPLICATION

This application is an U.S. national phase application under 35 U.S.C. § 371 based upon international patent application No. PCT/EP2022/064436 filed on May 27, 2022, which itself claims priority of Chinese Patent Application No. 2021105807002, entitled "AUTOMATIC WEBBING WINDING DEVICE AND BEDSIDE BED HAVING THE SAME", filed on May 26, 2021, the entire content of which is incorporated herein by reference.

TECHNICAL FIELD

The present disclosure relates to the technical field of beds, and more particularly, to an automatic webbing winding device and a bedside bed having the same.

BACKGROUND

Bedside beds (for example, cribs) are convenient for caregivers to take care of infants, which can especially resolve the problem that caregivers need to get up frequently at night to take care of infants. When the caregivers sleep at night, the bedside bed can be placed next to the adult bed for easy care. In order to fix the bedside bed relative to the adult bed, and to avoid an excessive gap between the two, a webbing is usually used to fix the bedside bed to the adult bed. However, if the caregiver does not pack the webbing properly after use, the webbing looks messy and untidy. In addition, when the webbing is not used (when the bedside bed does not need to be fixed), the webbing cannot be wound up automatically. Consequently, it is very inconvenient for the user to wind up the webbing, and the webbing is also likely to be thrown away and lost after being removed.

Therefore, it is necessary to provide an automatic webbing winding device and a bedside bed having the same to resolve the foregoing shortcomings in the prior art.

SUMMARY

According to some embodiments, an automatic webbing winding device and a bedside bed having the same are provided.

An automatic webbing winding device includes: a base; a winding reel mounted on the base and rotatable around a center of the base; a coil spring mounted on the winding reel, wherein one end of the coil spring is fixed to the winding reel, and the other end of the coil spring is fixed to the base; and a webbing mounted on the winding reel, wherein the webbing includes a fixed end and a free end, the fixed end is fixed to the winding reel, and the free end extends out from the base; wherein when the free end is pulled outward by an external force, the winding reel rotates along a forward direction, and the coil spring is elastically deformed, when the external force is removed, the winding reel rotates along a reverse direction under an elastic restoring force of the coil spring, thereby winding the webbing on the winding reel.

A bedside bed includes a bottom plate; a plurality of side plates surrounding the bottom plate; and the aforementioned automatic webbing winding device.

The details of one or more embodiments of the present disclosure are set forth in the accompanying drawings and the description below. Other features, objects and advantages of the present disclosure will become apparent from the description, drawings and claims.

BRIEF DESCRIPTION OF THE DRAWINGS

To illustrate the technical solutions according to the embodiments of the present invention more clearly, the accompanying drawings for describing the embodiments are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Figure 1:
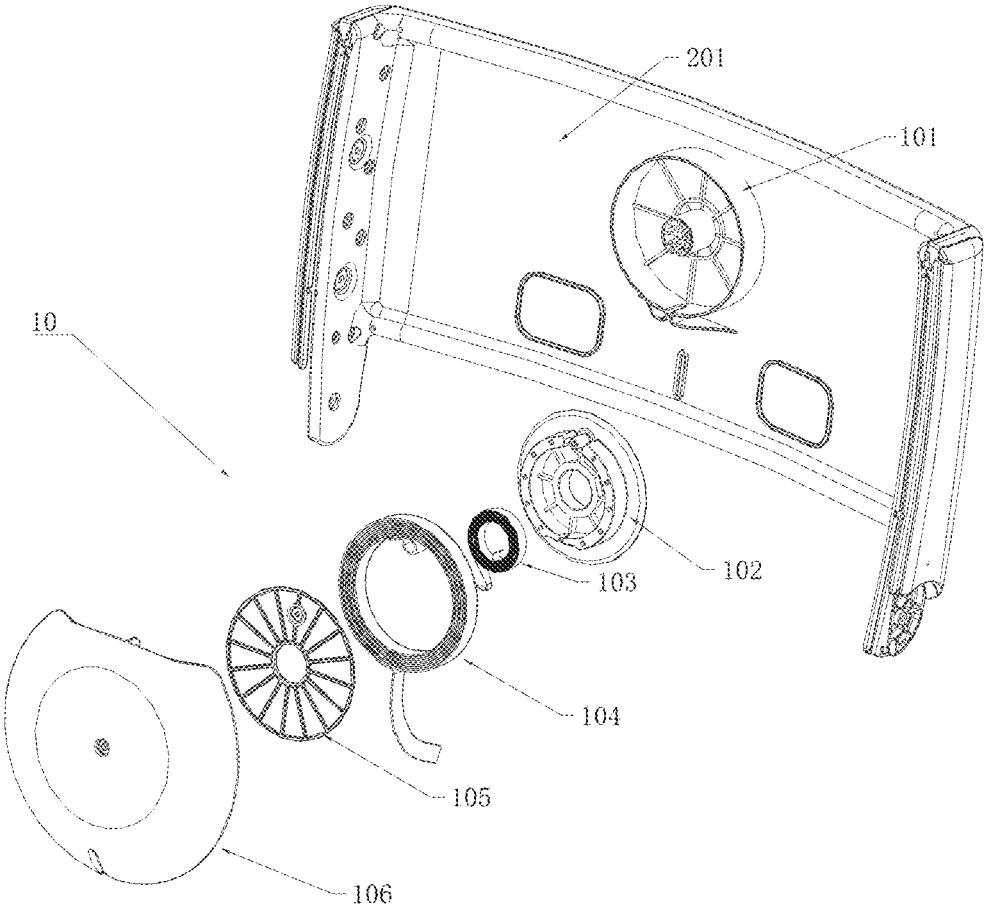
FIG. 1 is an exploded perspective view of an automatic webbing winding device mounted on a side plate of a bed according to an embodiment.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising." when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

According to an embodiment of the present disclosure, an automatic webbing winding device 10 is provided. The automatic webbing winding device 10 is adapted to be mounted to a fixed member, such as a bedside bed 20. As shown in FIG. 1 to FIG. 11, the automatic webbing winding device 10 includes a base 101, a winding reel 102, a coil spring 103, and a webbing 104.

The base 101 includes a bottom surface 1011 and a substantially annular side wall 1012 that surrounds the bottom surface 1011. A center position of the bottom surface 1011 is provided with a protrusion 1013, and the side wall 1012 is provided with a channel 1014 at a bottom thereof. The winding reel 102 is rotatably mounted in the base 101 and is located on the bottom surface 1011. A center of the winding reel 102 is provided with a through hole 1021 corresponding to the protrusion 1013, and the protrusion 1013 extends through the through hole 1021. The coil spring 103 is sleeved around the protrusion 1013 and is located on the winding reel 102. The coil spring 103 has one end fixed to the protrusion 1013 and the other end fixed to the winding reel 102. The webbing 104 is wound into an annular shape, and has a fixed end fixed to the winding reel 102 and a free end 1042 passing through the channel 1014 of the side wall 1012. When the free end 1042 of the webbing 104 is pulled outward under an external force, the winding reel 102 rotates around a center of the base 101 along a forward direction, such that the coil spring 13 is elastically deformed. When the external force is removed, the winding reel 102 rotates along a reverse direction under an elastic restoring force of the coil spring 103, thereby winding the webbing 104 on the winding reel 102. In some embodiments, the forward direction may be clockwise, and the reverse direction may be counterclockwise, or vice versa.

Figure 10:
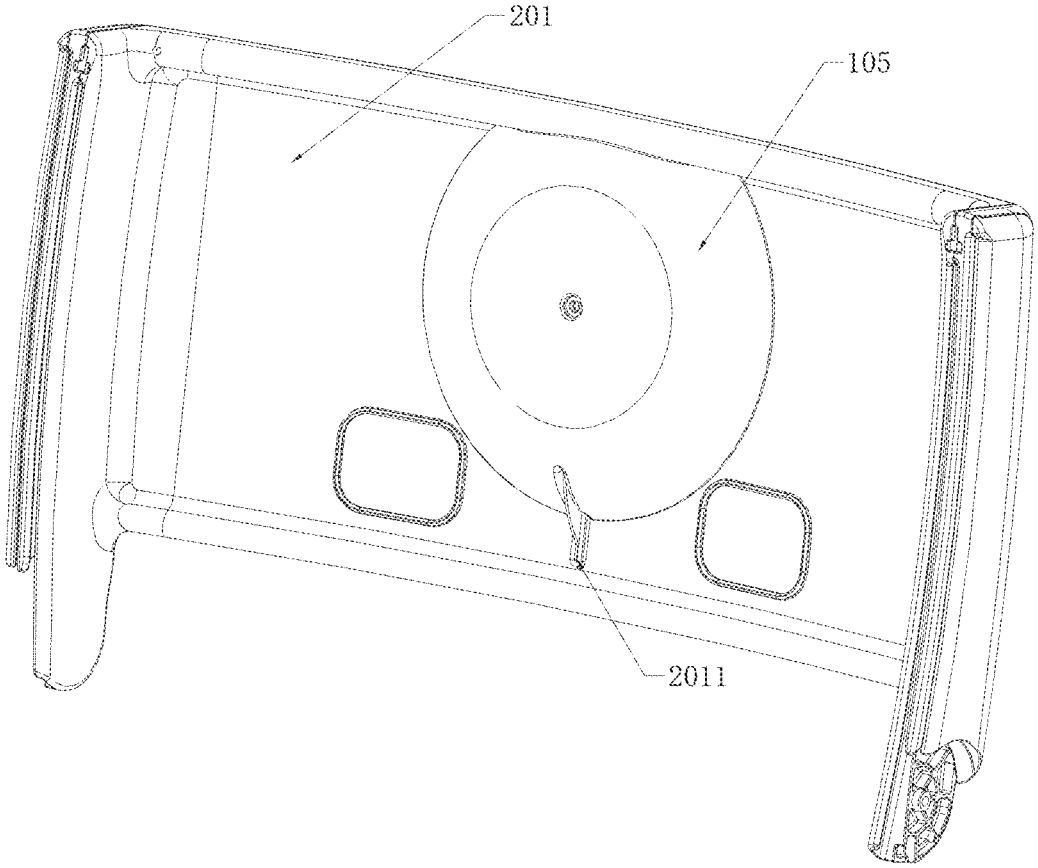
FIG. 10 is a perspective view of the automatic webbing winding device shown in FIG. 1.
Figure 11:
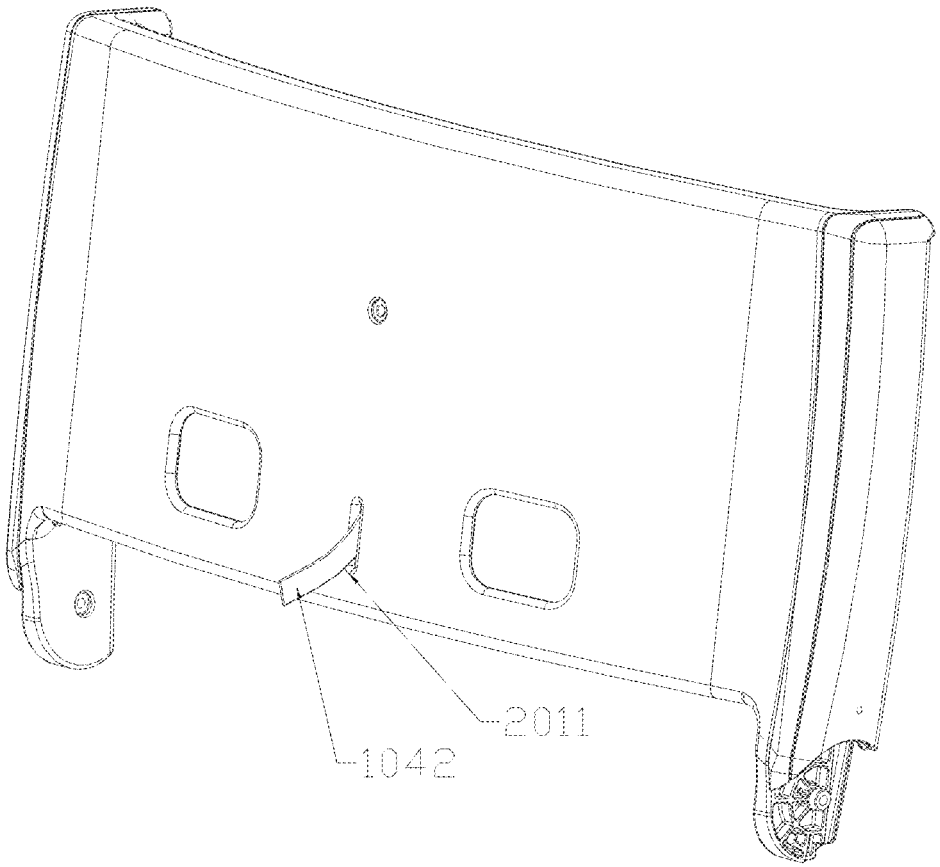
FIG. 11 is a perspective view of the automatic webbing winding device shown in FIG. 1 viewed from another aspect.

The automatic webbing winding device 10 further includes a winding reel cover 105. A center of the winding reel cover 105 is provided with a through hole, which is aligned with the protrusion 1013 of the base 101. The winding reel cover 105 is mounted on the winding reel 102 and is configured to cover the webbing 104, the coil spring 103, and the winding reel 102. The automatic webbing winding device 10 further includes a base cover 106. The base cover 106 is fixed to the base 101 and is configured to cover the housing of the base 101. As shown in FIG. 1, FIG. 10, and FIG. 11, a center of the base cover 106 is provided with a hole, and a center of the protrusion 1013 of the base 101 is also provided with a center through hole. The hole at the center of the base cover 106 is aligned with the center through hole of the protrusion 1013 of the base 101, such that the base cover 106 and the base 101 are fixed together through fasteners such as a screw. When the base 101 is integrally formed with a side plate 201 of the bedside bed 20, the center through hole of the protrusion 1013 of the base 101 is directly provided on the side plate 201. The base cover 106 is fixed to the side plate 201 through fasteners such as a screw, thereby covering the base 101 and other components inside. In some embodiments, the base cover 106 is made of a flexible material or wrapped with a flexible material, so as to avoid injury to infants due to collision in the bed.

In this embodiment, the base 101 is integrally formed with the side plate 201 of the bedside bed 20, that is, the bottom surface 1011 of the base 101 is the side plate 201, and the side wall 1012 is also integrated with the bottom surface 1011 and the side plate 201. In other embodiments, the base 101 may alternatively be an independent component, that is, may not be integrated with the side plate 201, and the bottom surface 1011 and the side wall 1012 may not be integrally formed, and may be connected by a means known in the art.

Figure 2:
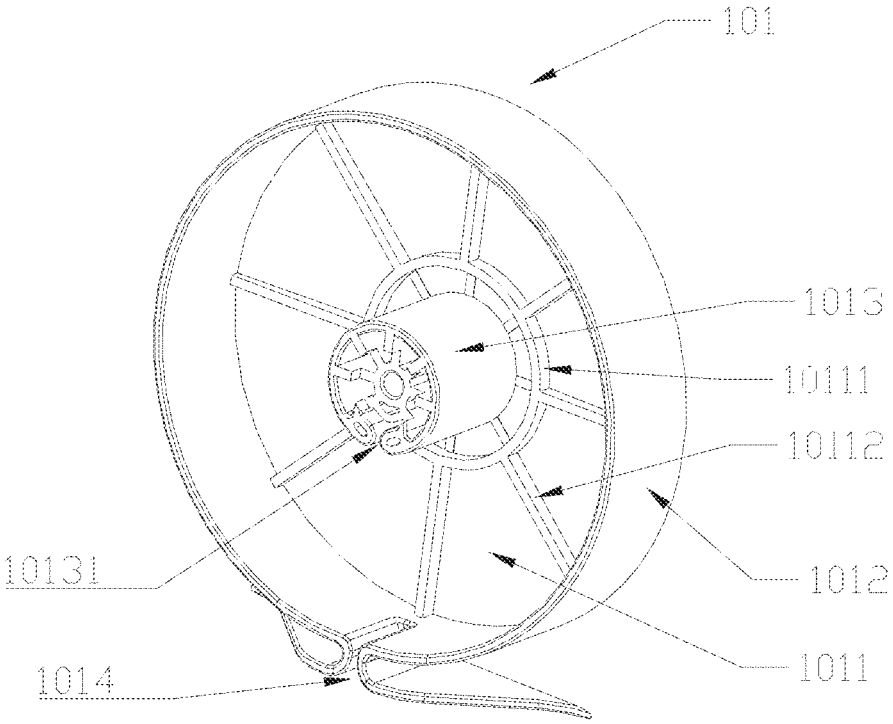
FIG. 2 is an enlarged view of a base of the automatic webbing winding device shown in FIG. 1.
Figure 3:
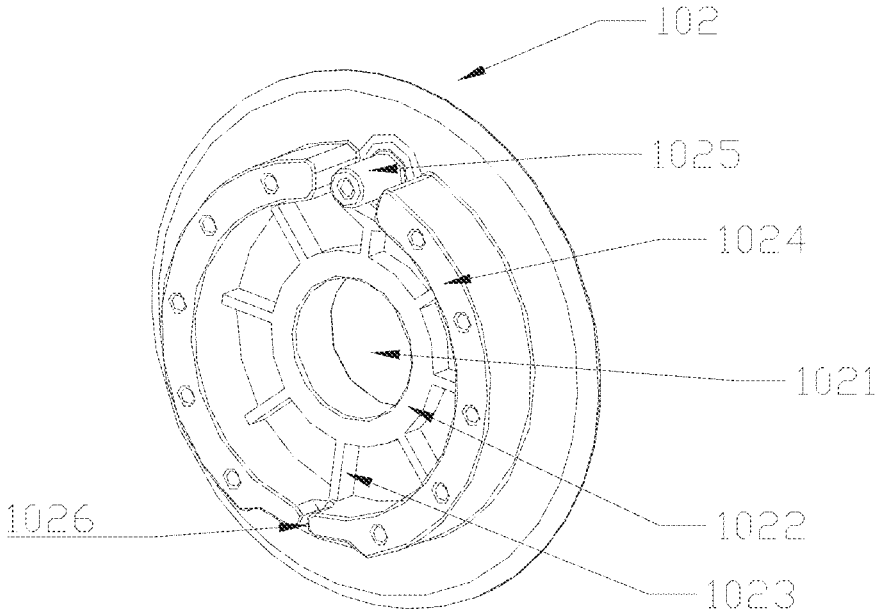
FIG. 3 is an enlarged view of a winding reel of the automatic webbing winding device shown in FIG. 1.
Figure 6:
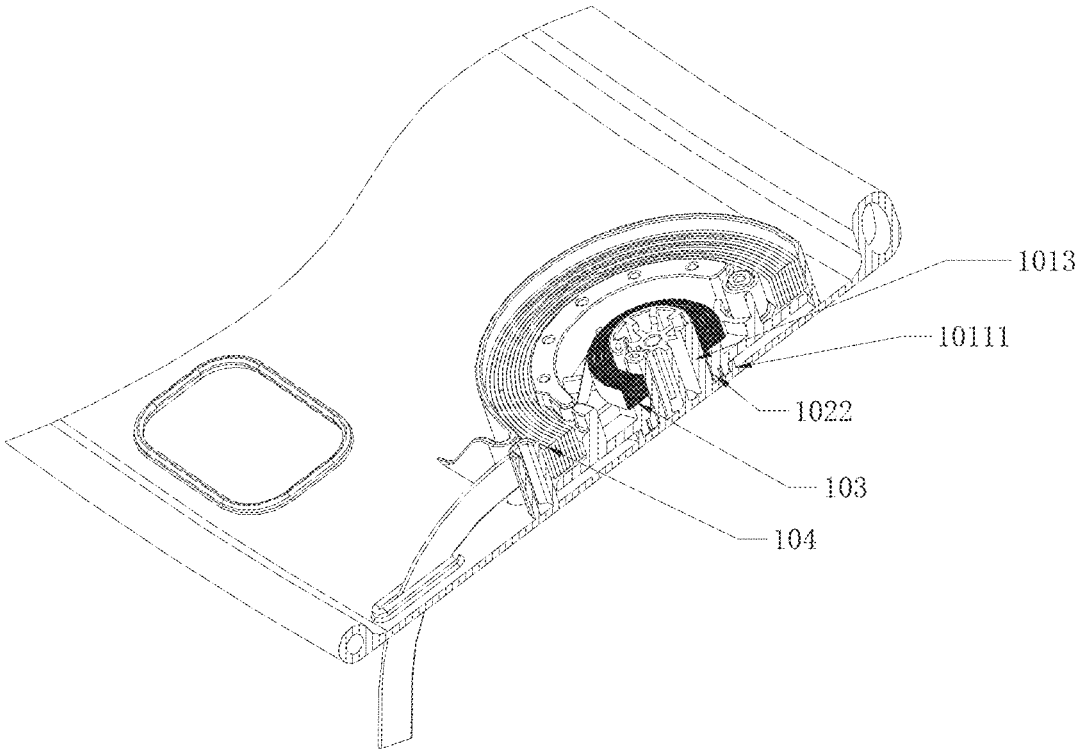
FIG. 6 is a partial enlarged view of FIG. 5.
Figure 7:
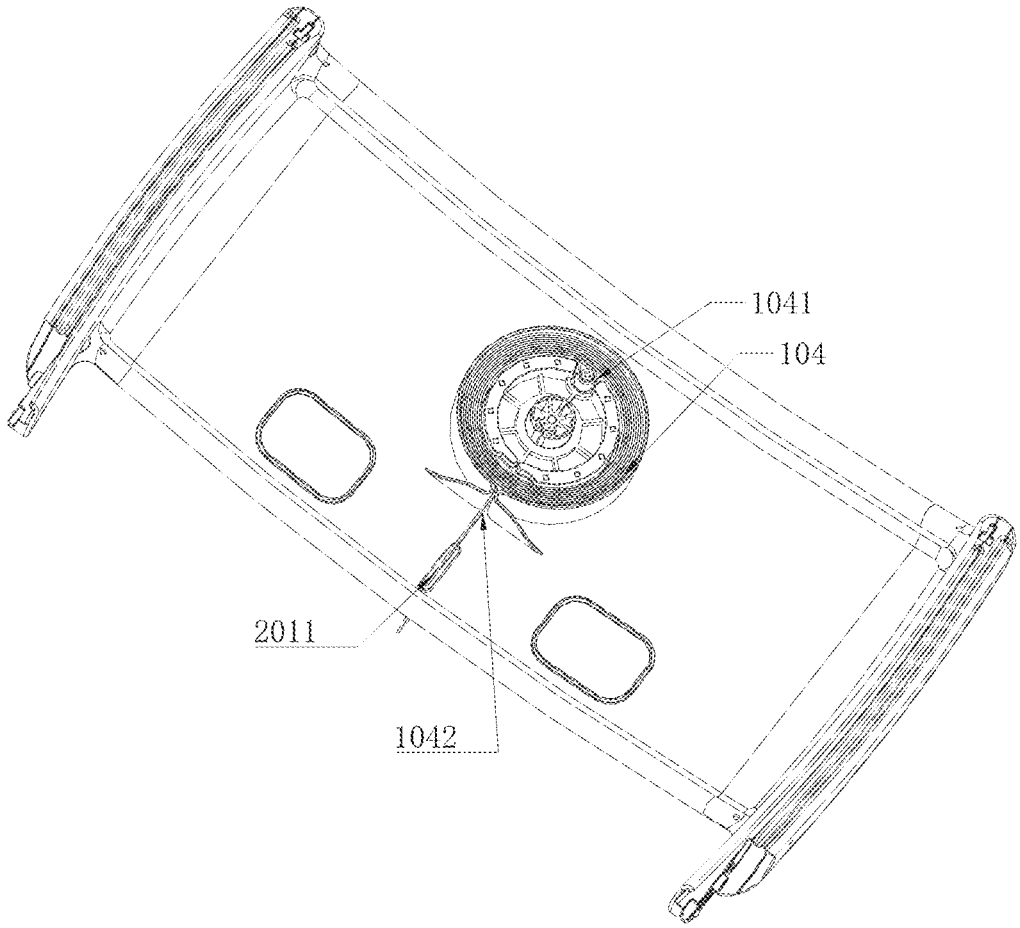
FIG. 7 is a perspective view of the automatic webbing winding device shown in FIG. 1 with the base cover, the winding reel cover, and the coil spring being removed.

Referring to FIG. 2, FIG. 3, and FIG. 6, the bottom surface 1011 of the base 101 includes an annular protrusion member 10111 surrounding the protrusion 1013. The winding reel 102 includes two flanges 1022 surrounding the through hole 1021, and the flanges 1022 are formed on both side surfaces of the winding reel 102, respectively. The annular protrusion member 10111 corresponds to the flange 1022 of the winding reel 102, such that the flange 1022 can be accommodated in an annular region formed by the annular protrusion member 10111 and the protrusion 1013. As such, by accommodating the flange 1022 of the winding reel 102 in the annular region formed by the annular protrusion member 10111 and the protrusion 1013, the position of the winding reel 102 can be limited, such that the rotation of the winding reel 102 becomes more stable.

As shown in FIG. 3, the winding reel 102 further includes a plurality of protruding ribs 1023 extending from the flange 1022. Relative to a main body plane of the winding reel 102, heights of the protruding ribs 1023 are the same as that of the flange 1022, in other words, the protruding ribs 1023 and the flange 1022 are in the same plane. In the illustrated embodiment, there are eight protruding ribs 1023, which are arranged symmetrically. By arranging the protruding ribs 1023, when the coil spring 103 is mounted on the winding reel 102, a contact area and a friction force between the coil spring 103 and the winding reel 102 are reduced.

Figure 8:
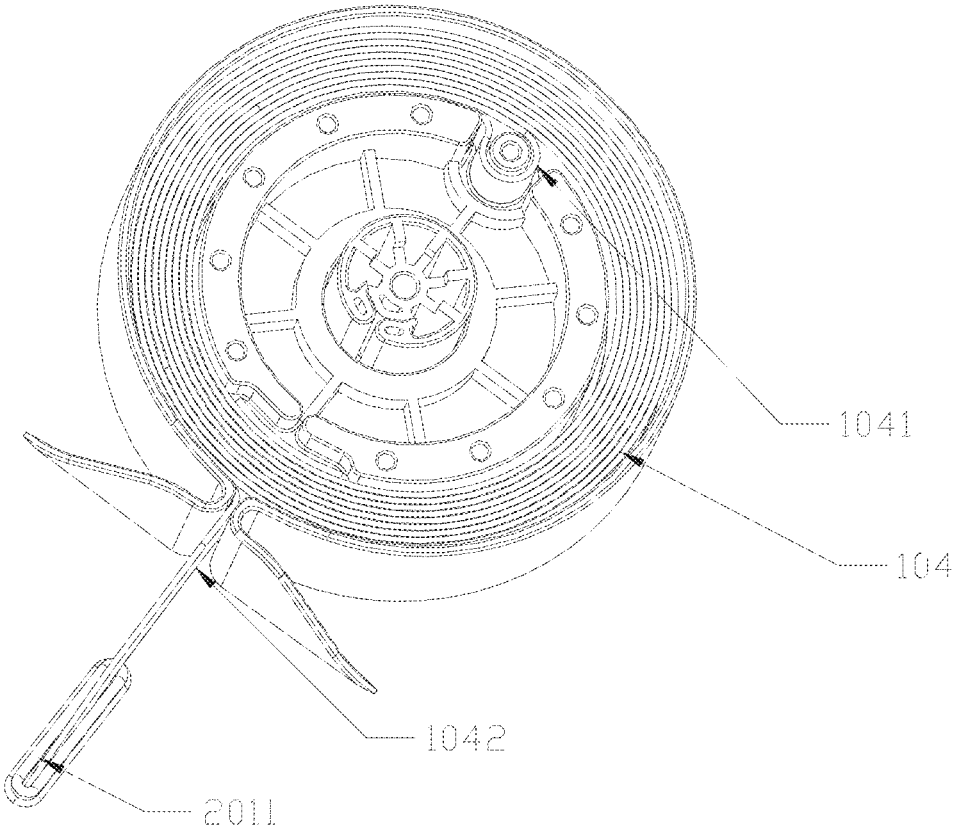
FIG. 8 is a partial enlarged view of FIG. 7.
Figure 9:
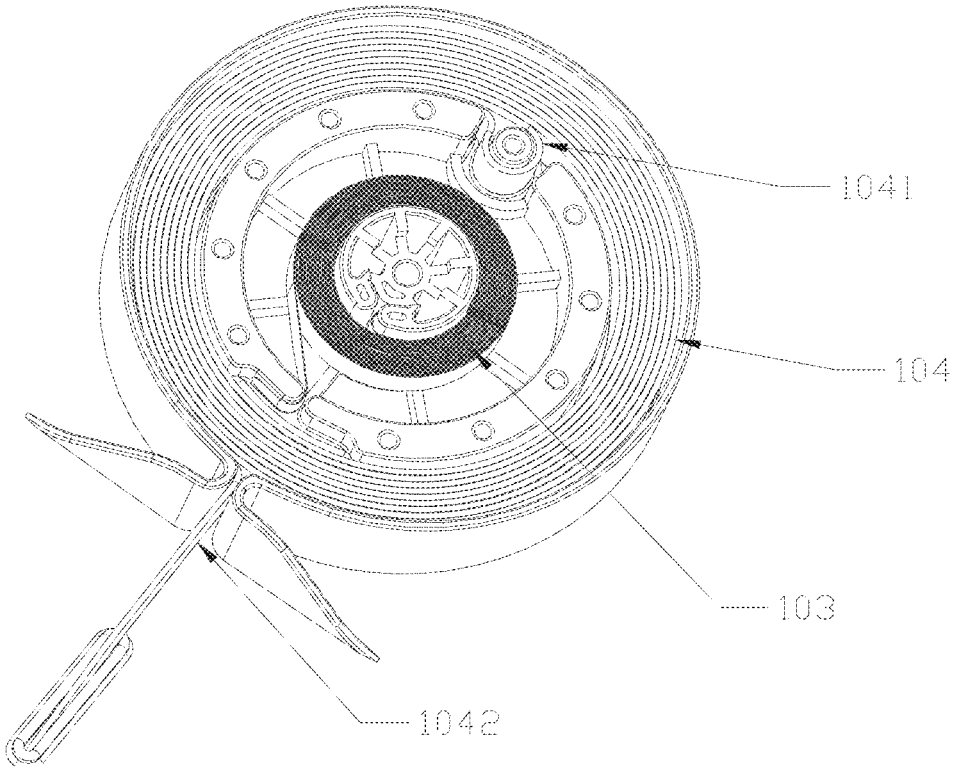
FIG. 9 is a perspective of FIG. 8 with the coil spring being mounted.

As shown in FIG. 2, the bottom surface 1011 of the base 101 further includes a plurality of protruding ribs 10112 extending from the annular protrusion member 10111. Relative to the bottom surface 1011, the protruding ribs 10112 and the annular protrusion member 10111 are at the same height, in other words, the annular protrusion member 10111 and the protruding ribs 10112 are in the same plane. In this embodiment, there are eight protruding ribs 10112, which are arranged symmetrically. By arranging the protruding ribs 10112, when the winding reel 102 is mounted on the base 101, a contact area and a friction force between the winding reel 102 and the base 101 are reduced. The side wall of the protrusion 1013 of the base 101 is provided with a notch 10131, and one end of the coil spring 103 is fixed in the notch 10131. As shown in FIG. 8 and FIG. 9, a cross-section of the notch 10131 is Y-shaped. As such, when fixing the coil spring 103, the end of the coil spring 103 can be fixed on a left side of the Y-shaped notch 10131 or on a right side of the notch 10131. As shown in FIG. 9, the coil spring 103 is fixed on the right side of the Y-shaped notch 10131. As such, when the webbing 104 is pulled by an external force, the coil spring 103 is elastically deformed and wound tightly along a counterclockwise direction, and when the external force is removed, the webbing 104 is tightened along a clockwise direction under an elastic restoring force of the coil spring 103. On the contrary, if the coil spring 103 is fixed on the left side of the Y-shaped notch 10131, when the webbing 104 is pulled by the external force, the coil spring 103 is elastically deformed and wound tightly along the clockwise direction, and when the external force is removed, the webbing 104 is tightened along the counterclockwise direction under the elastic restoring force of the coil spring 103.

As shown in FIG. 3, the winding reel 102 further includes two semi-annular protrusion members 1024 and a post 1025. The two semi-annular protrusion members 1024 are arranged opposite to each other on a side surface of the winding reel 102. The post 1025 is located between opposite ends of the two semi-annular protrusion members 1024. The post 1025 is configured to fix the fixed end 1041 of the webbing 104. The semi-annular protrusion members 1024 surround the flange 1022 and are located at a periphery of the flange 1022. One end of each of the semi-annular protrusion member 1024 is narrowed, and a gap 1026 is formed between narrowed ends of the two semi-annular protrusion members 1024. The gap 1026 is configured to fix one end of the coil spring 103. The narrowed end of the semi-annular protrusion member 1024 can prevent the end of the coil spring 103 fixed in the gap 1026 from being hooked to the webbing 104. As shown in FIG. 6. FIG. 8, and FIG. 9, the webbing 104 is wound into an annular shape and is sleeved on a periphery of the semi-annular protrusion member 1024, the fixed end 1041 of the webbing 104 is fixed to the post 1025, and the free end 1042 of the webbing 104 extends from the channel 1014 of the side wall 1012. In the present embodiment, the channel 1014 is a slit that allows the webbing 104 to move smoothly through the side wall 1012.

Figure 4:
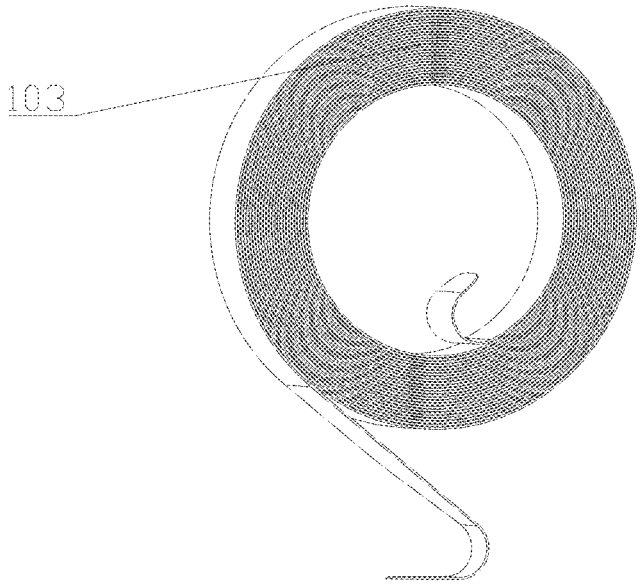
FIG. 4 is an enlarged view of a coil spring of the automatic webbing winding device shown in FIG. 1.
Figure 5:
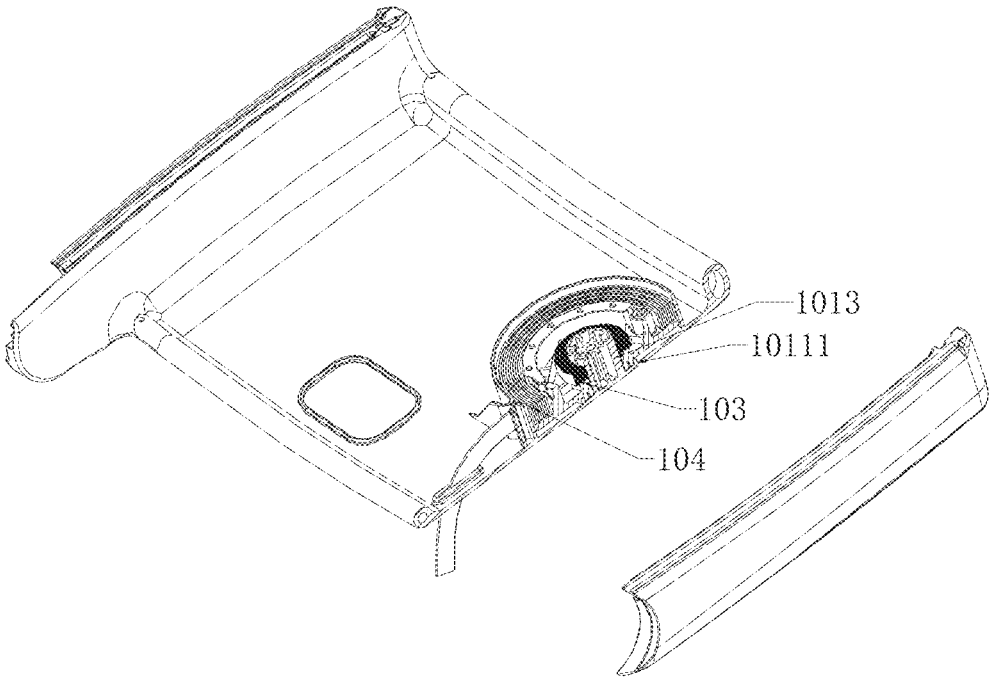
FIG. 5 is a cross-sectional view of the automatic webbing winding device shown in FIG. 1 with a base cover and a winding reel cover being removed.

Referring to FIG. 4, both ends of the coil spring 103 are bent, so as to be fixed into the notch 10131 of the base 101 and the gap 1026 of the winding reel 102, respectively. Therefore, one end of the coil spring 103 is fixed on the base 101, and the other end thereof can be wound up with the rotation of the winding reel 102 when the external force is applied, or move along the opposite direction under the elastic restoring force of the coil spring 103 when the external force is removed.

According to the aforementioned automatic webbing winding device 10, one end of the coil spring 103 is fixed in the notch 10131 of the base 101, and the other end thereof is fixed in the gap 1026 of the winding reel 102. When there is no external force to pull the webbing 104, the webbing 104 is always in an automatic winding state under an action of the coil spring 103. When the webbing 104 is to be used, the webbing 104 is pulled outward to cause the winding reel 102 to rotate along a forward direction, such that the coil spring 103 is wound up, and a winding force of the coil spring 103 is stored. After the external force is removed, the coil spring 103 rotates along a reverse direction under its clastic restoring force, and the winding reel 102 winds the webbing 104 around the winding reel 102, so as to achieve the automatic winding of the webbing 104. The automatic webbing winding device 10 can automatically wind up the redundant webbing 104 when the webbing 104 is not in use, which makes the webbing 104 relatively neat and convenient, and also prevents the webbing 104 from being thrown away and lost after being removed.

Figure 12:
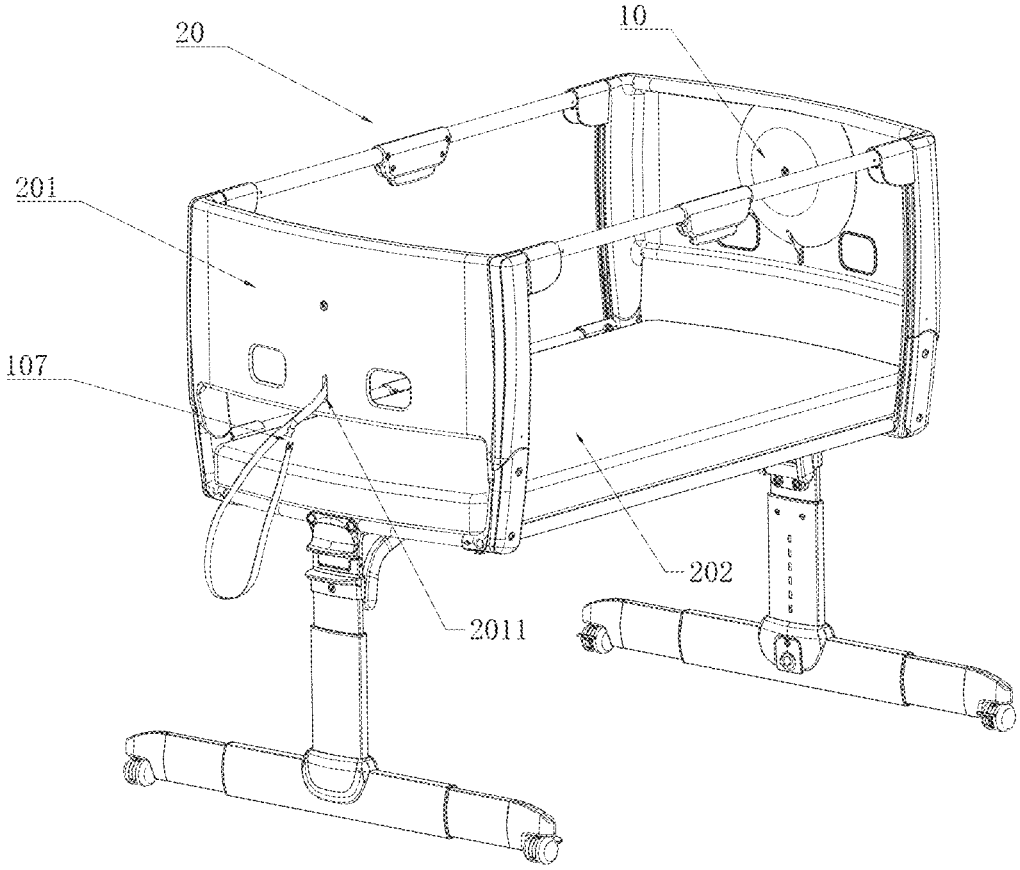
FIG. 12 is a perspective view of a bedside bed according to an embodiment.
Figure 13:
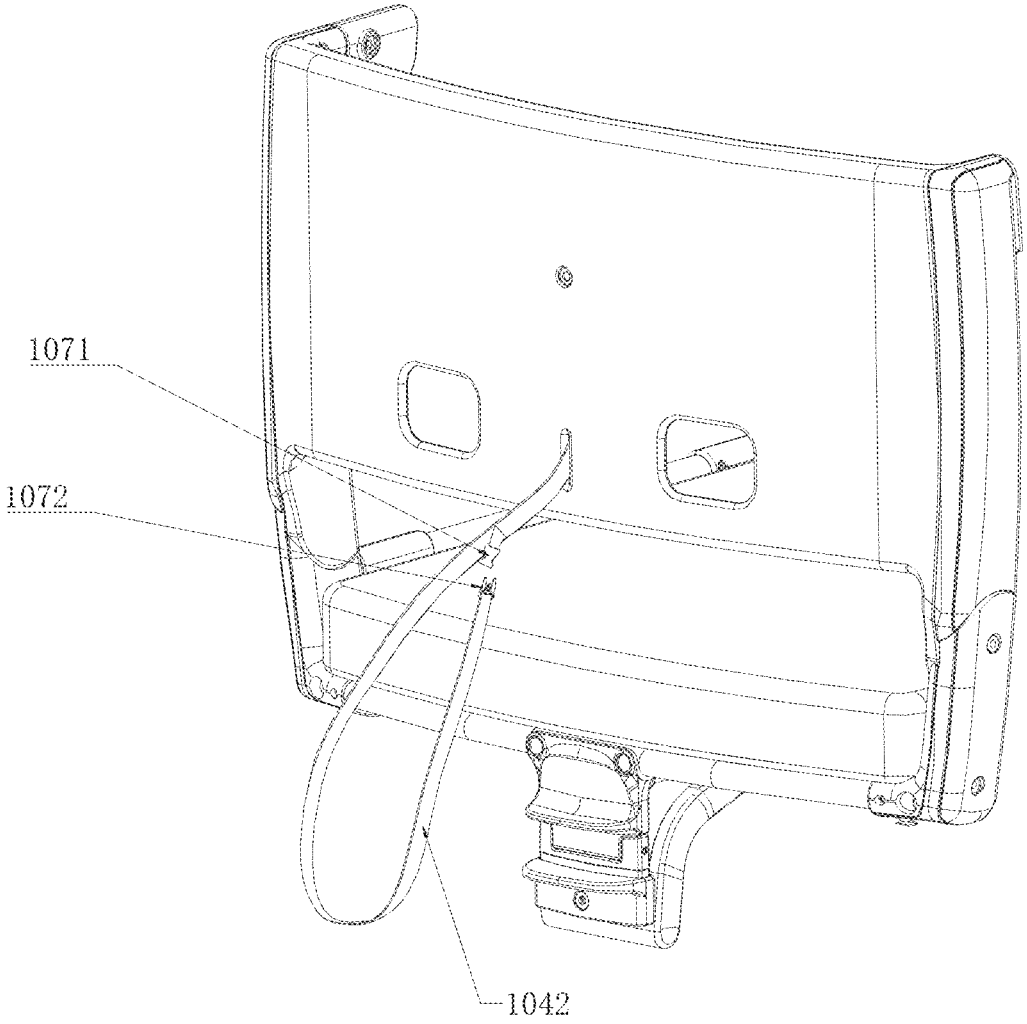
FIG. 13 is a partial enlarged view of a bedside bed shown in FIG. 12.

As shown in FIG. 12, a bedside bed 20 according to an embodiment is provided, which includes the automatic webbing winding device 10 described above. The bedside bed 20 includes a bottom plate 202 and a plurality of side plates 201. The bottom plate 202 is approximately parallel to a ground, the plurality of side plates 201 are approximately perpendicular to the ground and surround the bottom plate 202, and at least one side plate 201 is provided with a webbing outlet 2011. The automatic webbing winding device 10 is mounted on an inner side of the side plate 201, and the free end 1042 of the webbing 104 passes through the webbing outlet 2011. In this embodiment, two automatic webbing winding devices 10 are arranged on the two side plates 201, respectively. The automatic webbing winding device 10 is fixed to the inner side of the side plate 201 by common connection manners in the art, for example, screwed connection or other manners. In one embodiment, the base 101 of the automatic webbing winding device 10 is integrally formed with the side plate 201, as shown in FIG. 5 to FIG. 7, FIG. 10, and FIG. 11.

In some embodiments, the automatic webbing winding device 10 further includes a snapping structure 107. The snapping structure 107 includes a first snapping member 1071 located on the webbing 104 and a second snapping member 1072 located at the free end 1042 of the webbing 104. The first snapping member 1071 and the second snapping member 1072 can be snapped together, so as to fix the free end 1042 of the webbing 104 to a fixing object, such as an adult bed.

Figure 14:
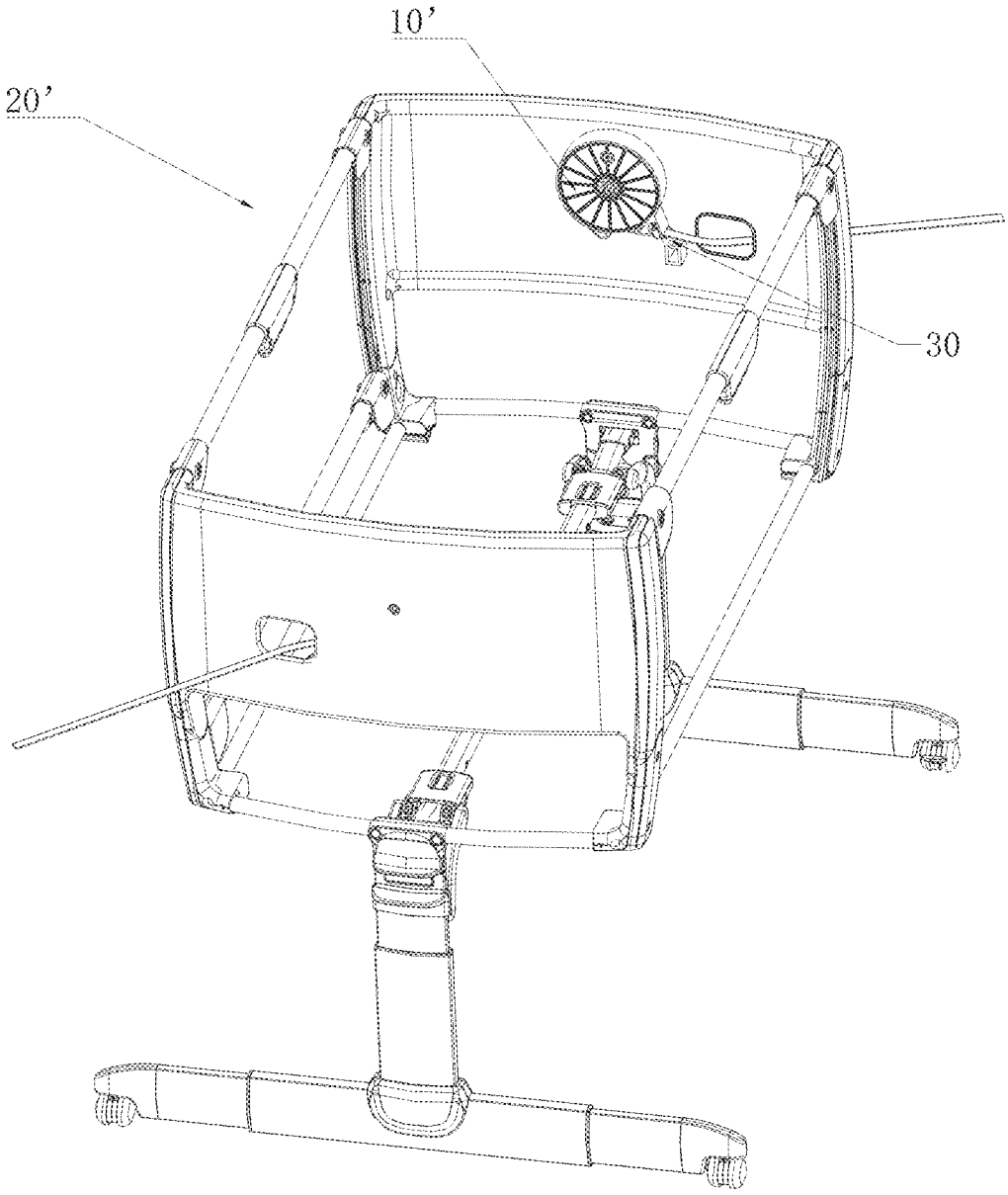
FIG. 14 is a perspective view of a bedside bed according to another embodiment.
Figure 15:
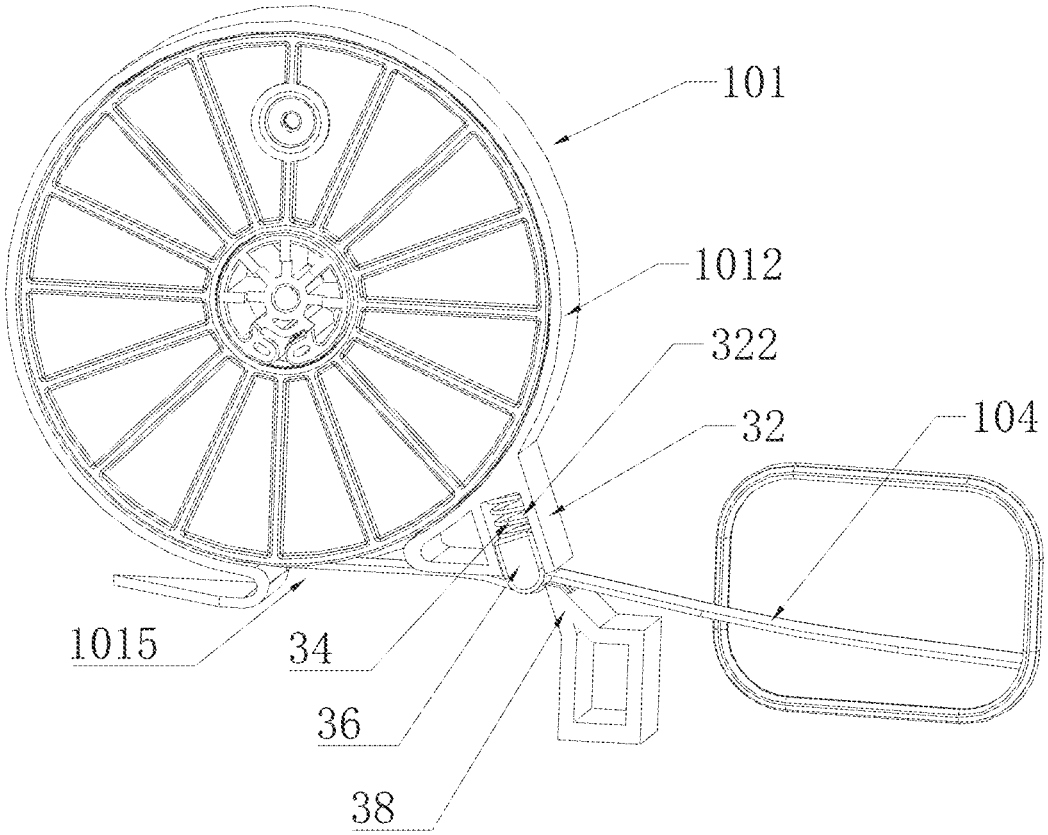
FIG. 15 is a partial enlarged view of FIG. 14.
Figure 16:
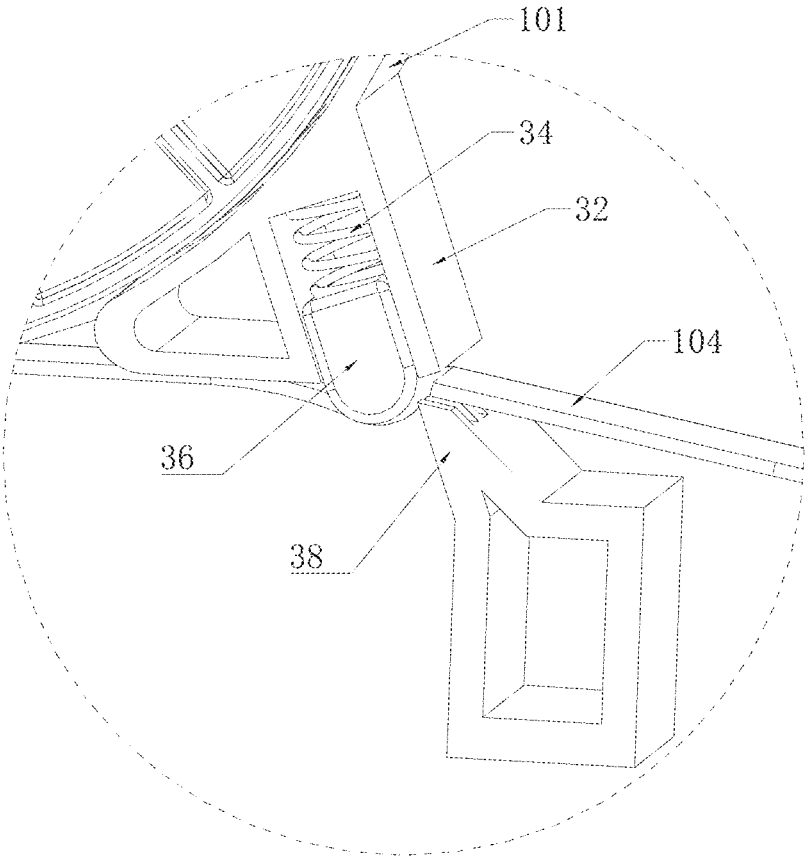
FIG. 16 is a partial enlarged view of FIG. 15.

Referring to FIG. 14 to FIG. 16, a bedside bed 20' according to another embodiment is provided, which is similar to the bedside bed 20 of the aforementioned embodiment. The difference lies in that the webbing winding device 10' further includes a webbing locking mechanism 30 located on the base 101. The webbing locking mechanism 30 is configured to selectively prevent the webbing 104 from pulling out from a channel 1015 of the side wall 1012. In this embodiment, in order to allow the webbing 104 to be pulled out of the base 101 smoothly, the channel 1015 is an opening sufficiently large as shown in FIG. 15.

Referring to FIG. 15, the webbing locking mechanism 30 includes a locking base 32, a restoring elastic member 34, a locking block 36, and a positioning tooth 38. The locking base 32 is provided on the side wall 1012 of the base 101 and is adjacent to the channel 1015. The locking base 32 is provided with a receiving cavity 322 having an opening therein. The restoring elastic member 34 and the locking block 36 are received in the receiving cavity 322. One end of the restoring elastic member 34 abuts against a bottom of the receiving cavity 322, the other end of the restoring elastic member 34 abuts against and biases the locking block 36. In this embodiment, the restoring elastic member 34 is a spring, but is not limited hereto. The restoring elastic member 34 can be an elastic block or other elastic elements that can provide a biasing force to the locking block 36. The locking block 36 is slidably received in the receiving cavity 322, and a top of the locking block 36 protrudes from the opening of the receiving cavity 322 and abuts against one side of the webbing 104 due to the restoring elastic member 34. The locking block 36 can be made of a material with a high friction coefficient, such as rubber or the like. Alternatively, the surface of the locking block 36 in contact with the webbing 104 may be surface treated with anti-slip bumps or textures, so as to provide enough friction to position the webbing 104 after the user secures the webbing 104. The positioning tooth 38 is provided on an inner side of the side plate 201 and is arranged opposite to the locking base 32. The positioning tooth 38 can selectively abut against the other side of the webbing 104. Referring to FIG. 16, an end of the positioning tooth 38 is misaligned with a center line of the locking block 36 that is received in the receiving cavity 322, such that there is a gap between the positioning tooth 38 and the locking block 36 to allow the webbing 104 to go through.

The working principle of the webbing locking mechanism 30 will be described in greater detail below. Referring to FIGS. 15 and 16, when the free end 1042 of the webbing 104 is fixed to the adult bed closed to the bedside bed 20' via the snapping structure 107, the excess and loosen webbing 104 goes on a back slope of the positioning tooth 38, and is rewound by the reel 102 into the inside of the base 101, so as to achieve the purpose of fixing the bedside bed 20' to the adult bed. At that time, the free end 1042 of the webbing 104 extends in a direction obliquely downward. The upper side of the webbing 104 is pressed by the locking block 36, and the lower side of the webbing 104 is pressed by the top of the positioning tooth 38, such that the webbing 104 is clamped by the locking block 36 and the positioning tooth 38 and is kept still relative to the base 101. Therefore, the webbing 104 is in a locking state that cannot be pulled out freely.

Figure 17:
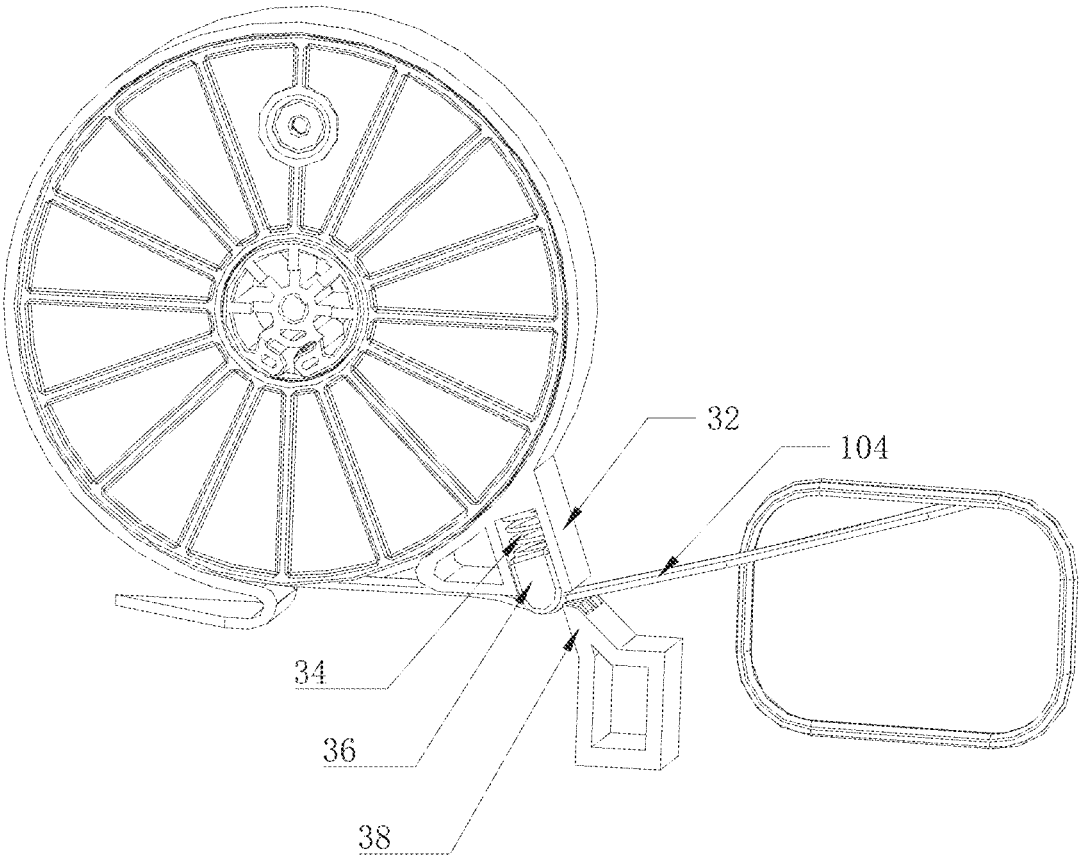
FIG. 17 is a perspective view of the automatic webbing winding device shown in FIG. 15 in another state.

Referring to FIG. 17, when the bedside bed 20' is about to be separated from the adult bed, the first snapping member 1071 and the second snapping member 1072 can be disengaged, and the free end 1042 of the webbing 104 then extends in a direction obliquely upward. At that time, the lower side of the webbing 104 is no longer in contact with the positioning tooth 38, while the upper side of the webbing 104 is still in contact with locking block 36. Since the side of the webbing 104 extending upwardly in contact with the locking block 36 can provide an upward pushing force to overcome the elastic force of the restoring elastic member 34, and push the locking block 36 into the accommodating cavity 322, the friction between the locking block 36 and the webbing 104 is too small to stop the movement of the webbing 104, and the free end 1042 of the webbing 104 can be pulled out of the channel 1015 of the side wall 1012 easily.

The technical features in the foregoing embodiments may be randomly combined. For concise description, not all possible combinations of the technical features in the embodiments are described. However, as long as combinations of the technical features do not conflict with each other, the combinations of the technical features are considered as falling within the scope described in this specification.

The foregoing embodiments only show some implementations of the present invention, although the descriptions are relatively specific and detailed, the implementations should not be understood as a limitation to the patent scope of the present invention. It should be noted that, a person of ordinary skill in the art may further make some variations and improvements without departing from the concept of the present invention, and these variations and improvements all fall within the protection scope of the present invention. Therefore, the protection scope of the patent of the present invention shall be subject to the appended claims.

The invention claimed is:

1. An automatic webbing winding device, comprising:

a base;

a winding reel mounted on the base and rotatable around a center of the base, the winding reel comprising:

two protrusion members arranged opposite to each other on a side surface thereof and a post located between opposite ends of the two protrusion members;

a coil spring mounted on the winding reel, wherein one end of the coil spring is fixed to the winding reel, and another end of the coil spring is fixed to the base; and a webbing mounted on the winding reel, wherein the webbing comprises a fixed end and a free end, the fixed end is fixed to the post of the winding reel, and the free end extends out from the base;

wherein when the free end is pulled outward by an external force, the winding reel rotates along a forward direction, and the coil spring is elastically deformed, when the external force is removed, the winding reel rotates along a reverse direction under an elastic restoring force of the coil spring, thereby winding the webbing on the winding reel.

2. The automatic webbing winding device according to claim 1, wherein the base comprises a bottom surface and a side wall surrounding the bottom surface, a center position of the bottom surface is provided with a protrusion, the side wall is provided with a channel, a center of the winding reel is provided with a through hole corresponding to the protrusion, the winding reel is mounted in the base and is located on the bottom surface, the protrusion extends through the through hole, the coil spring is sleeved around the protrusion and is located on the winding reel, the another end of the coil spring is fixed to the protrusion, the fixed end of the webbing is fixed to the winding reel, and the free end of the webbing extends through the channel of the side wall.

3. The automatic webbing winding device according to claim 2, wherein the bottom surface comprises an annular protrusion member surrounding the protrusion, the winding reel further comprises a flange surrounding the through hole, the annular protrusion member corresponds to the flange, such that the flange is accommodated in an annular region formed by the annular protrusion member and the protrusion.

4. The automatic webbing winding device according to claim 3, wherein the winding reel further comprises a plurality of protruding ribs extending from the flange.

5. The automatic webbing winding device according to claim 3, wherein the bottom surface further comprises a plurality of protruding ribs extending from the annular protrusion member.

6. The automatic webbing winding device according to claim 3, wherein the two protrusion members of the winding reel are two semi-annular protrusion the two semi-annular protrusion members surround the flange, one end of each of the two semi-annular protrusion members is narrowed, and a gap is formed between narrowed ends of the two semi-annular protrusion members, the one end of the coil spring is fixed to the gap.

7. The automatic webbing winding device according to claim 2, wherein a side wall of the protrusion is provided with a notch, and the another end of the coil spring is fixed in the notch.

8. The automatic webbing winding device according to claim 7, wherein a cross-section of the notch is Y-shaped.

9. The automatic webbing winding device according to claim 2, further comprising a webbing locking mechanism located on the base, wherein the webbing locking mechanism is configured to selectively prevent the webbing from pulling out from the channel of the side wall.

10. The automatic webbing winding device according to claim 9, wherein the webbing locking mechanism comprises:

a locking base provided on the base, the locking base having a receiving cavity;

a restoring elastic member received in the receiving cavity;

a locking block slidably received in the receiving cavity, the locking block being driven by the restoring elastic member to abut against one side of the webbing; and a positioning tooth arranged opposite to the locking base and selectively abutting against another side of the webbing, wherein the webbing remains stationary with respect to the base under a clamping action of the locking block and the positioning tooth.

11. The automatic webbing winding device according to claim 10, wherein an end of the positioning tooth is misaligned with a center line of the locking block.

12. The automatic webbing winding device according to claim 1, further comprising a winding reel cover mounted on the winding reel and configured to cover the webbing, the coil spring, and the winding reel.

13. The automatic webbing winding device according to claim 1, further comprising a base cover fixed to the base and configured to cover the base.

14. The automatic webbing winding device according to claim 13, wherein the base cover is made of a flexible material.

15. The automatic webbing winding device according to claim 1, wherein the one end and the another end of the coil spring are bent to be fixed to the base and the winding reel, respectively.

16. The automatic webbing winding device according to claim 1, further comprising a snapping structure, wherein the snapping structure comprises a first snapping member located on the webbing and a second snapping member located on the free end, the first snapping member is snapped to the second snapping member so as to fix the free end to a fixing object.

17. A bedside bed, comprising:

a bottom plate;

a plurality of side plates surrounding the bottom plate; and the automatic webbing winding device according to claim 1.

18. The bedside bed according to claim 17, wherein at least one of the plurality of side plates is provided with a webbing outlet, the free end extending out from the base goes through the webbing outlet.

19. The bedside bed according to claim 17, wherein the base is integrally formed with the plurality of side plates.

20. The bedside bed according to claim 17, wherein the base is mounted on the plurality of side plates via a connecting member.

* * * * *